US005259403A

United States Patent [19]

Guy et al.

[11] Patent Number: 5,259,403

[45] Date of Patent: Nov. 9, 1993

[54] PROCESS AND APPARATUS FOR EXPANDING TOBACCO CUT FILLER

[75] Inventors: Keith R. Guy, Winston-Salem; Dale B. Poindexter, East Bend, both of N.C.

[73] Assignee: R. J. Reynolds Tobacco Company, Winston-Salem, N.C.

[21] Appl. No.: 853,465

[22] Filed: Mar. 18, 1992

[51] Int. Cl.[5] ..... A24B 3/18

[52] U.S. Cl. ..... 131/291

[58] Field of Search ..... 131/290-292, 131/296, 300, 303, 900-901

[56] References Cited

U.S. PATENT DOCUMENTS

| | | | |
|---|---|---|---|
| Re. 32,013 | 10/1985 | de la Burde et al. . | |
| Re. 32,014 | 10/1985 | de la Burde et al. . | |
| 3,524,452 | 8/1970 | Stewart . | |
| 4,165,012 | 8/1979 | Markwood . | |
| 4,202,357 | 5/1980 | de la Burde et al. . | |
| 4,243,056 | 1/1981 | de la Burde et al. . | |
| 4,250,898 | 2/1981 | Utsch et al. . | |
| 4,253,474 | 3/1981 | Hibbitts et al. | 131/140 |
| 4,258,729 | 3/1981 | de la Burde et al. . | |
| 4,295,337 | 10/1981 | Johnson et al. . | |
| 4,308,876 | 1/1982 | Rothchild . | |
| 4,310,006 | 1/1982 | Hibbitts et al. | 131/290 |
| 4,333,483 | 6/1982 | de la Burde et al. . | |
| 4,336,825 | 6/1982 | Piion . | |
| 4,340,073 | 7/1982 | de la Burde et al. | 131/291 |
| 4,366,825 | 1/1992 | Utsch et al. . | |
| 4,377,173 | 3/1983 | Rothchild . | |
| 4,388,932 | 6/1983 | Merritt et al. . | |
| 4,460,000 | 7/1984 | Steinberg . | |
| 4,519,407 | 5/1985 | Hellier | 131/291 |
| 4,528,994 | 6/1985 | Korte et al. . | |
| 4,561,453 | 12/1985 | Rothchild . | |
| 4,572,218 | 2/1986 | Hine et al. | 131/303 X |
| 4,760,854 | 8/1988 | Jewell et al. . | |
| 4,870,980 | 10/1989 | Lowry . | |
| 5,095,922 | 3/1992 | Johnson et al. . | |
| 5,095,923 | 3/1992 | Kramer . | |
| 5,143,096 | 9/1992 | Steinberg | 131/291 |

FOREIGN PATENT DOCUMENTS

| | | |
|---|---|---|
| 0484899 | 5/1992 | European Pat. Off. . |
| 9006695 | 6/1990 | PCT Int'l Appl. . |

*Primary Examiner*—Jessica J. Harrison
*Assistant Examiner*—Jennifer Doyle

[57] ABSTRACT

Tobacco cut filler is volume expanded using the DIET process and equipment. During depressurization of a pressure vessel containing a mixture of cut filler impregnated with liquid carbon dioxide, gaseous carbon dioxide is bubbled through the mixture to provide a mixture of decreased density and decreased integrity. Liquid water is introduced into the sublimator region of the equipment in order to act as a heat sink, causing tobacco cut filler in that region and related equipment components to not experience overly high exposure to heat. A vertically extending duct in the sublimator region has a relatively large inner diameter so as to allow adequate residence time of the tobacco cut filler in the expansion region. A spray of water applied to the expanded tobacco cut filler and atmosphere in the post expansion region of the DIET equipment moistens the cut filler and reduces the temperature experienced thereby.

21 Claims, 3 Drawing Sheets

FIG. 1 (PART 1)

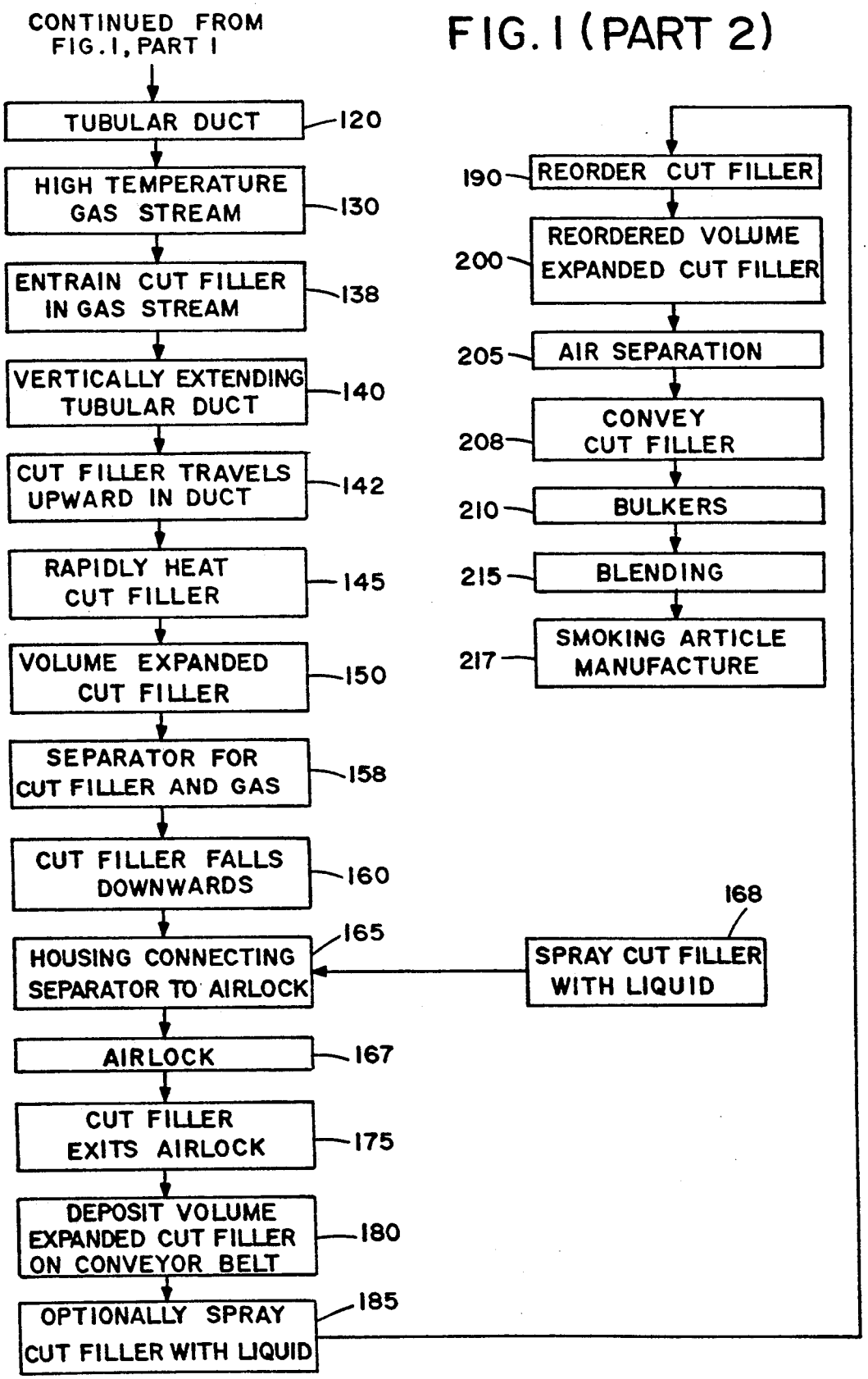
FIG. 1 (PART 2)
CONTINUED FROM FIG. 1, PART 1
TUBULAR DUCT
120
HIGH TEMPERATURE GAS STREAM
130
ENTRAIN CUT FILLER IN GAS STREAM
138
VERTICALLY EXTENDING TUBULAR DUCT
140
CUT FILLER TRAVELS UPWARD IN DUCT
142
RAPIDLY HEAT CUT FILLER
145
VOLUME EXPANDED CUT FILLER
150
SEPARATOR FOR CUT FILLER AND GAS
158
CUT FILLER FALLS DOWNWARDS
160
HOUSING CONNECTING SEPARATOR TO AIRLOCK
165
SPRAY CUT FILLER WITH LIQUID
168
AIRLOCK
167
CUT FILLER EXITS AIRLOCK
175
DEPOSIT VOLUME EXPANDED CUT FILLER ON CONVEYOR BELT
180
OPTIONALLY SPRAY CUT FILLER WITH LIQUID
185
190
REORDER CUT FILLER
200
REORDERED VOLUME EXPANDED CUT FILLER
205
AIR SEPARATION
208
CONVEY CUT FILLER
210
BULKERS
215
BLENDING
217
SMOKING ARTICLE MANUFACTURE

PROCESS AND APPARATUS FOR EXPANDING TOBACCO CUT FILLER

BACKGROUND OF THE INVENTION

The present invention relates to tobacco materials useful for the manufacture of cigarettes, and in particular, to apparatus and processes for providing volume expansion of such tobacco materials.

Popular smoking articles, such as cigarettes, have a substantially cylindrical rod shaped structure and include a charge of smokable material such as shredded tobacco material (e.g., in cut filler form) surrounded by a paper wrapper thereby forming a so-called "tobacco rod". Normally, a cigarette has a cylindrical filter element aligned in an end-to-end relationship with the tobacco rod. Typically, a filter element includes cellulose acetate tow circumscribed by plug wrap, and is attached to the tobacco rod using a circumscribing tipping material. It also has become desirable to perforate the tipping material and plug wrap, in order to provide dilution of drawn mainstream smoke with ambient air.

Tobacco material undergoes various processing stages prior to the time it is used as cut filler for cigarette manufacture. Oftentimes, the tobacco material is chemically and/or physically altered to modify its organoleptic, smoking and/or physical characteristics. In certain circumstances, it is desirable to process the tobacco material so as to increase the filling capacity of that material. In particular, it may be desirable to decrease the density of an aged tobacco material by expanding or puffing that material. Certain tobacco expansion processes are set forth in U.S. Pat. No. 30,693 to Fredrickson; U.S. Pat. No. 3,524,452 to Moser et al.; U.S. Pat. No. 3,683,937 to Fredrickson et al.; U.S. Pat. No. 3,771,533 to Armstrong; U.S. Pat. No. 4,235,250 to Utsch; U.S. Pat. No. 4,248,252 to Lendvay et al.; U.S. Pat. No. 4,258,729 to de la Burde et al.; U.S. Pat. No. 4,266,562 to Merritt et al.; U.S. Pat. No. 4,531,529 to White, et al.; U.S. Pat. No. 4,870,980 to Lowry; U.S. Pat. No. 5,031,644 to Kramer; U.S. Pat. No. 5,065,774 to Grubbs et al.; U.S. Pat. No. 5,076,293 to Kramer and U.S. Pat. No. 5,095,922 to Johnson et al.; which are incorporated herein by reference.

One method for volume expanding a tobacco material involves contacting that material with liquid (e.g., supercooled) carbon dioxide so as to impregnate that material with the liquid carbon dioxide, subjecting the impregnated tobacco material to conditions sufficient to convert at least a portion (e.g., a substantial amount) of the liquid carbon dioxide to solid carbon dioxide to provide a solid carbon dioxide-containing tobacco material, and subjecting the solid carbon dioxide-containing tobacco material to conditions sufficient to vaporize the solid carbon dioxide so as to expand the tobacco material. Such a method is referred to as a dry-ice expanded tobacco process or a "DIET" process. See, for example, the technologies proposed in U.S. Pat. No. 32,013 to de la Burde, et al; U.S. Pat. No. 32,014 to Sykes, et al; U.S. Pat. No. 4,202,357 to de la Burde et al; U.S. Pat. No. 4,308,876 to Rothchild; U.S. Pat. No. 4,377,173 to Rothchild; U.S. Pat. No. 4,388,932 to Merritt et al; U.S. Pat. No. 4,165,012 to Markwood; U.S. Pat. No. 4,243,056 to de la Burde et al; U.S. Pat. No. 4,250,898 to Utsch et al; U.S. Pat. No. 4,258,729 to de la Burde et al; U.S. Pat. No. 4,295,337 to Johnson et al; U.S. Pat. No. 4,307,735 to Snow et al; U.S. Pat. No. 4,312,369 to Mullen III et al; U.S. Pat. No. 4,333,483 to de la Burde et al and U.S. Pat. No. 4,366,825 to Banyasz; which are incorporated herein by reference.

The DIET process as conventionally employed can suffer from several deficiencies. In one regard, the solid carbon dioxide-containing tobacco material often has the form of a large frozen block or mass which is of quite high density and integrity, making such block or mass difficult to break into smaller pieces which can be handled and processed easily and efficiently in further processing steps. In another regard, the solid carbon dioxide-containing tobacco material is subjected to contact with a continuous stream of high temperature steam laden gas in a sublimator region in order to vaporize the solid carbon dioxide; and temporary interruption of introduction of solid carbon dioxide-containing tobacco material into the stream of high temperature gas can cause the tobacco material within the sublimator region to experience contact with the high temperature gas at an undesirably high temperature for a relatively long period of time, thus resulting in toasted, burned or charred tobacco material. In yet another regard, high temperatures experienced by the tobacco material in the sublimator region and during post-expansion collection, and movement of the tobacco material within the continuous steam of high temperature gas, can result in an undesirable toasting of the tobacco material as well as undesirable breakage of the tobacco material into small particles or fines.

It would be desirable to provide a process for efficiently and effectively expanding a tobacco material, and in particular, to provide expanded tobacco material using improved DIET processes and equipment.

SUMMARY OF THE INVENTION

The present invention relates to improved processing techniques and equipment useful for expanding tobacco material, and most preferably to improved processing techniques and equipment useful for expanding tobacco material using the DIET process.

In one aspect, the present invention relates to a method for reducing the integrity or solidity of a large frozen mass of fluid-containing impregnated tobacco material. That is, the present invention relates to a method for providing a solidified (i.e., frozen) mass which can be processed further (e.g., opened, broken into small pieces or declumped) in an efficient, effective manner, preferably without degrading the tobacco material within the frozen mass to a significant degree. The method involves contacting a mixture of tobacco material and liquid fluid (e.g., liquid carbon dioxide) which is contained in a pressurized vessel with a gaseous fluid (e.g., gaseous carbon dioxide) during the period of time that the vessel undergoes depressurization. In particular, the mixture of tobacco material and liquid fluid is contacted with a gaseous fluid prior to, during and just after the period of time that the liquid fluid undergoes a change in state from liquid to solid. For example, when the liquid fluid is carbon dioxide, the gaseous fluid normally is contacted with the mixture prior to, during and just after the period that the pressure experienced within the vessel is about 60 psig. Preferably, the gaseous fluid is bubbled upwards through the tobacco material impregnated with liquid carbon dioxide in order to (i) form a plurality of gaseous regions, pockets or bubbles suspended within the frozen mass which results, or (ii) separate to some degree the such, the density and integrity of the mass are decreased, the individual pieces of tobacco material experience a low propensity to freeze together, the volume of the frozen mass is increased, and the frozen mass exhibits a propensity to be more easily broken or otherwise divided (or further divided) into small pieces.

In another aspect, the present invention relates to a process and means for minimizing the propensity of tobacco material to undergo an undesirable overly long contact period with a high temperature gas in a sublimator region during tobacco material expansion steps. In particular, pieces of tobacco material impregnated with solidified fluid (e.g., solid carbon dioxide) are introduced in a predetermined amount (e.g., at a predetermined rate) into a sublimator region where that tobacco material is contacted with a stream of high temperature gas (e.g., a continuous stream, such as a stream of a steam laden gas) traveling at a predetermined rate and having a predetermined temperature so as to rapidly heat and expand the tobacco material. However, the time period over which the predetermined amount of tobacco material remains in contact with the high temperature gas, and the amount of heat experienced by that tobacco material, are not so great that the tobacco material is toasted, scorched, charred or burned. In addition, over-heating in the sublimator region, which can cause air-locks and related equipment to over-heat and hence seize up or otherwise not operate properly, normally is avoided due to the heat sinking nature of the frozen tobacco material (e.g., heat is absorbed to vaporize the frozen fluid, heat is absorbed by the tobacco material, and heat is absorbed by the moisture present in the tobacco material). Thus, during periods of time when relatively low amounts of tobacco material are introduced into the sublimator region (e.g., due to an interruption in the supply of tobacco material) and the temperature in that region begins to rise to an undesirably high temperature (i.e., because there is insufficient tobacco material, fluid and moisture present to act as an adequate heat sink for the heat provided by the continuous high temperature gas stream), a vaporizable fluid (e.g., liquid water) is introduced in a controlled manner into the high temperature gas stream to act as a heat sink, and hence (i) control the temperature within the duct, and (ii) reduce to a significant degree the propensity of tobacco material within the sublimator region to experience an undesirable over-heating. However, when the temperature within the sublimator region is reduced to a desired level (e.g., due to renewed introduction of a significant amount of tobacco material into that region) the introduction of the vaporizable fluid is reduced or ceased.

In yet another aspect, the present invention relates to an improvement to the DIET process and equipment. In particular, the present invention relates to a sublimator region including a vertically directed duct of relatively large inner diameter. Such a region of the duct has increased inner diameter relative to other regions thereof, particularly relative to the region of the duct where the tobacco material is introduced into the duct to contact the stream of high temperature gas, in order that the tobacco material therein experiences a reduced velocity, improved mixing with the high temperature gas, improved uniformity of heat transfer, increased residence time in the sublimator region, and improved separation efficiency. As such, expanded tobacco material of good quality and high yield is provided.

In still another aspect, the present invention relates to further improvements to the DIET process and equipment. In particular, expanded tobacco material present within the DIET expansion apparatus and in contact with high temperature atmosphere is contacted with a spray or mist of a heat sinking material (e.g., a spray or mist of a liquid fluid such as water). Such heat sinking material acts to cool the surrounding atmosphere, cool the surrounding equipment components and cool the expanded tobacco material. When the heat sinking material is water, that material also acts to moisten the expanded tobacco material. As such, the propensity of surrounding equipment components (e.g., an airlock) to malfunction (e.g., seize up) due to overheating is minimized. In addition, the propensity of the expanded tobacco material to be heated sufficiently to experience an undesirable change in chemical composition (e.g., due to the reaction of an undesirably high level of sugars within the tobacco material) is minimized.

DETAILED DESCRIPTION OF THE PREFERRED EMBODIMENTS

Exemplary DIET processes and apparatus are employed by Philip Morris, Inc. and at The Corby B.A.T. XT Plant in Corby, U.K.; and a suitable DIET process and apparatus can be provided and installed by the Airco Industrial Gases Division of The B.O.C. Group, Inc. As such, specific details of the DIET process and apparatus will be apparent to the skilled artisan.

The tobacco material which is processed according to the present invention can vary. Suitable types of tobaccos include flue-cured, Burley, Oriental and Maryland tobaccos, as well as the rare and specialty tobaccos. Normally, the tobacco material has been aged. The form of the tobacco material can vary. The tobacco can be in the form of whole leaf, strip (i.e., predominantly tobacco leaf laminae), stem, cut filler (e.g., strands or shreds of laminae normally provided from tobacco strip), shredded stem, or cut-rolled stem. Also useful are those processed (e.g., extracted) tobacco materials of the type described in U.S. Patent No. 5,065,775 to Fagg and U.S. Pat. No. 5,095,922 to Johnson et al. In highly preferred aspects of the present invention, the tobacco material is in a cut filler form. Typical cut filler has a width which ranges from about 1/20 inch to about 1/50 inch, preferably from about 1/25 inch to about 1/35 inch; and a length which ranges from about 0.25 inch to about 3 inches.

Figure 1:
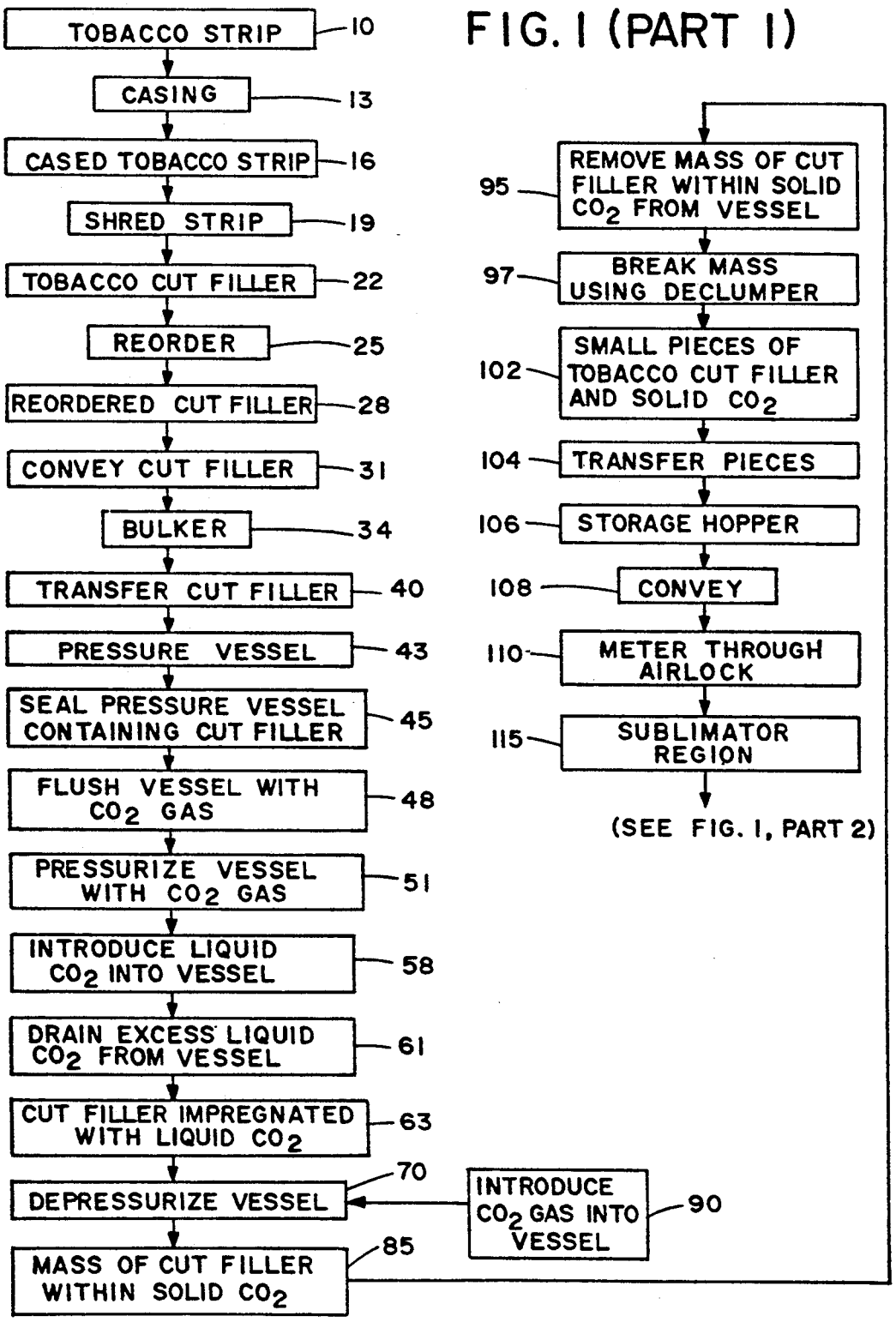
FIG. 1, which is presented in two parts, is a schematic diagram of steps representative of an embodiment of process steps of the present invention.

Referring to FIG. 1, tobacco strip 10 (e.g., flue cured tobacco laminae, or a blend of flue cured tobacco laminae and Burley tobacco laminae) is cased 13 using known casing techniques and equipment (e.g., a rotary casing drum) to provide cased tobacco strip 16. Normally, the tobacco strip is cased with water and an optional humectant (e.g., glycerine); and although not preferred, the tobacco strip can be cased with other casing components (e.g., cocoa and/or licorice). The cased strip 16 is cut or otherwise shredded 19 at about 25 cuts per inch to about 35 cuts per inch, preferably about 30 cuts per inch, using known cutting or shredding techniques so as to provide tobacco cut filler 22. The cut filler 22 is reordered 25 to a desired moisture level using a rotary drum or similar techniques. Typically, the cut filler is reordered so as to provide a reordered cut filler 28 having a glycerine content of about 0 to about 10, preferably about 1 to about 5, and more preferably about 2 to about 3 weight percent; and a moisture content of about 15 to about 35, preferably about 18 to about 30, and more preferably about 20 to about 25 weight percent. The reordered tobacco cut filler 28 then is conveyed 31 to a bulker 34 using known conveying techniques and equipment.

The reordered tobacco cut filler 28, which typically is at about ambient temperature is charged 40 into a pressure vessel 43, and most preferably a pressure vessel having both a top lid and a bottom lid. The pressure vessel is described in greater detail with reference to FIG. 2. Exemplary pressure vessels are described in U.S. Pat. No. 4,312,369 to Mullen III et al or are available from Scholz GmbH & Co. Typically, about 750 to about 1,100, usually about 800 to about 1,000, and frequently about 825 to about 900 pounds of the reordered cut filler are charged into a cylindrical vessel having a 1.32 meter inner diameter and a 2.2 meter inner height. The reordered cut filler 28 is transferred to the pressure vessel 43 from the bulker 34 using a conveying mechanism that will be apparent to the skilled artisan. Preferably, the conveying mechanism includes a conveyor to accept and measure a desired weight of cut filler, a conveyor to hold the cut filler until feeding of the cut filler into the vessel is desired, and a telescopic chute through which the cut filler is dumped into the pressure vessel. For example, the top lid of the pressure vessel is opened, the chute is moved into place to cover the resulting opening in the top of the pressure vessel, the holding conveyor then provides loading of the desired amount of cut filler into the pressure vessel, the chute is retracted, and the top lid of the pressure vessel is closed.

The pressure vessel 43 containing reordered tobacco cut filler is sealed 45 and flushed with gaseous carbon dioxide 48. The pressure vessel then is pressurized 51 to a pressure significantly above ambient (i.e., atmospheric) pressure. The pressure within the vessel normally is above about 300 psig, and is about generally about 380 to about 500, often about 400 to about 450, and frequently about 410 preferably about 425 psig. The manner in which the gaseous carbon dioxide is supplied can vary, is not particularly critical, and suitable sources and pumping mechanisms will be apparent to the skilled artisan. The temperature within the vessel can vary, and can be higher than, lower than, or equal to, ambient temperature. However, the temperature within the vessel usually is quite cold, as the gaseous carbon dioxide normally is provided as a recycled fluid from earlier DIET expansion operations. Liquid carbon dioxide 58 then is introduced into the pressure vessel, preferably so as to cover, and hence saturate, the cut filler. The manner in which the liquid carbon dioxide is obtained and supplied to the vessel can vary, is not particularly critical, and will be apparent to the skilled artisan. See, for example, U.S. Pat. No. 4,295,337 to Johnson et al. The liquid carbon dioxide usually has a temperature of about 10° F. to about 30° F., often about 15° F. to about 25° F. About 4,000 to about 5,000 pounds of liquid carbon dioxide normally are introduced into the vessel. The pressure within the vessel remains essentially constant (e.g., remains at about 410 to about 425 psig), as gaseous carbon dioxide is allowed to vent from the vessel to a carbon dioxide process tank as liquid carbon dioxide is introduced thereto. The liquid carbon dioxide then is drained 61 from the vessel by gravity drain or by forcing carbon dioxide gas into the vessel in order to force out excess liquid carbon dioxide, so as to provide cut filler 63 impregnated with liquid carbon dioxide within the pressurized vessel. Vented gaseous carbon dioxide and drained liquid carbon dioxide can be recovered for reuse in substantial amounts using known recovery techniques. Each of the gaseous carbon dioxide and liquid carbon dioxide are fluids consisting predominantly of carbon dioxide (e.g., can have minor amounts of purities, such as air); and industrial grade or food grade carbon dioxide is particularly useful. Carbon dioxide having a purity of greater than 99 weight percent is particularly preferred.

The pressure vessel 43 is depressurized 70. The manner in which the vessel is depressurized can vary, but normally involves opening a valve to allow gaseous carbon dioxide to vent from the vessel. The vessel can be depressurized continuously in a one-step manner, or the vessel can be depressurized in stages in a step-wise manner. The rate at which the gaseous carbon dioxide is vented from the vessel can vary. Preferably, vented gaseous carbon dioxide is recovered in one or more recovery vessels, and recycled for reuse. In one aspect, the pressure vessel is depressurized in a three step manner. For example, the pressure vessel experiencing an internal pressure of about 415 psig can be depressurized over a period of about 15 to about 25 seconds to yield an internal pressure of about 120 psig; and then depressurized over a period of about 15 to about 25 seconds to yield an internal pressure of about 50 psig; and then depressurized over a period of about 15 to about 25 seconds to yield an internal pressure of about 0 psig (i.e., ambient pressure).

During depressurization 70, the liquid carbon dioxide changes state to become solid carbon dioxide (i.e., the triple point of carbon dioxide is −69.8° F. and 60.4 psig). As such, a large mass 85 of tobacco cut filler within solid carbon dioxide (i.e., solid carbon dioxide-containing or solid carbon dioxide impregnated cut filler) is provided. The liquid carbon dioxide changes state to become solid carbon dioxide when the vessel is depressurized to a pressure of about 60 psig to about 61 psig.

During depressurization 70, gaseous carbon dioxide is introduced 90 into the vessel. In particular, gaseous carbon dioxide is introduced through an inlet port in the bottom of the vessel so as to pass or bubble through the mixture of liquid carbon dioxide and cut filler. Preferably, the gaseous carbon dioxide is introduced into the vessel prior to, during and just after the period of time that the vessel experiences an internal pressure of about 60 psig (i.e., during the period of time that the liquid carbon dioxide changes state to solid carbon dioxide). For example, gaseous carbon dioxide can be introduced into the vessel during depressurization when the internal pressure experienced by the vessel reaches a pressure below about 80 psig (e.g., a pressure of about 70 psig to about 80 psig), and such introduction can continue until the internal pressure experienced by the vessel reaches a pressure below about 55 psig (e.g., a pressure of about 50 psig to about 55 psig). It is preferable to not introduce any further gaseous carbon dioxide into the vessel after the pressure experienced within the vessel falls much below about 55 psig in order to avoid an undesirable degree of sublimation of frozen carbon dioxide which is impregnated within the tobacco material. Normally, the gaseous carbon dioxide which is introduced into the vessel is quite cold (i.e., has a temperature of about 10° F. to about 30° F.). As such, the amount of gaseous carbon dioxide and the rate that the gaseous carbon dioxide is introduced into the vessel can vary, and can be determined by experimentation. The gaseous carbon dioxide is introduced into the vessel at a sufficient rate so as to reduce the integrity of the frozen tobacco material; but at not so great a rate as to undesirably affect the depressurization of the vessel, and hence adversely affect the solidification of the liquid carbon dioxide. Preferably, the gaseous carbon dioxide is introduced so as to pass upwards through the tobacco material, and hence lift and separate that tobacco material to lower the density of that tobacco material. The gaseous carbon dioxide provides for a frozen or solidified mass of solid carbon dioxide impregnated cut filler which is less difficult to break into smaller pieces during later processing steps. Typically, the gaseous carbon dioxide causes the solidified mass to exhibit a volume which is significantly greater than that which would be exhibited by a similar mass provided under similar circumstances, but while not having gaseous carbon dioxide introduced into the pressure vessel during depressurization. Although the increase in volume of the solidified mass provided by the introduction of gaseous carbon dioxide during depressurization is limited by factors such as the size of the vessel, typical volume increases of that solidified mass exceed about 10 percent and often exceed about 20 percent. Gaseous materials other than gaseous carbon dioxide can be introduced into the vessel during depressurization; however, such other gaseous materials are much less preferred, as recycling of the carbon dioxide for reuse in processing further amounts of tobacco material is made more difficult.

The large mass 85 of tobacco cut filler and solid carbon dioxide is removed 95 from the vented pressure vessel 43 by opening the bottom lid of the pressure vessel and allowing the frozen mass to fall from the vessel. Preferably, the frozen mass falls from the pressure vessel as a plurality of pieces, rather than as one large solid mass. The frozen mass generally weighs about 5 to about 15 percent, usually about 10 percent, more than that of the reordered tobacco cut filler which is introduced into the vessel; and such increase in weight results primarily from the carbon dioxide introduced during the processing steps. The frozen mass generally exhibits a temperature of about −109° F. The frozen mass falls into a bin and into a opener unit, milling unit or declumper unit so as to break 97 or subdivide the frozen mass into small pieces 102. An exemplary opener unit is described in U.S. Pat. No. 4,307,735 to Snow et al, and other suitable opener units will be apparent to the skilled artisan. Optionally, horizontally spaced bars can be positioned in the bin so as to assist in breaking the frozen mass into smaller pieces before the frozen mass reaches the declumper unit. Typically, the frozen mass 85 is broken into pieces 102 or "granules" having a size of less than about 2 inches in diameter, and usually about ⅛ inch to about 1 inch in diameter.

The small pieces of solid carbon dioxide-containing tobacco cut filler 102 are transferred 104 using an insulated conveyor to an insulated storage hopper 106, such as a hopper available as Vibrabin from the Airco Industrial Gases Division of The B.O.C. Group, Inc. The small pieces are conveyed 108 using a suitable conveyor system from the hopper 106 to a metering region (e.g., a metering band conveyor) and are metered through an airlock 110 (e.g., a suitable star valve or rotary valve) to a sublimator region 115. Airlock 110 provides for the continuous or continual introduction of tobacco material into the sublimator (i.e., expansion) region while allowing for the continuous stream of high temperature gas to be maintained. In the sublimator region, hot gases cause rapid sublimation of the carbon dioxide as well as vaporization of moisture in the tobacco material to cause inflammation, and hence expansion, of the cell structure of that tobacco material. The specific temperature or specific temperature range of the high temperature gas can vary, and can be determined or selected as desired by the skilled artisan. Preferably, the temperature of the high temperature gas is above about 600° F. Normally, the pieces of solid carbon dioxide-containing tobacco cut filler 102 are introduced at a rate of about 5,000 to about 12,000, usually about 6,000 to about 11,000, and often about 7,000 to about 10,000 lb./hr. downward through the airlock into a horizontally positioned tubular stainless steel duct 120, such as is described in greater detail with reference to FIG. 3. Preferably, a venturi area is provided in the region where the tobacco material is introduced into the horizontal duct.

The solid carbon dioxide-containing cut filler 102 is subjected to conditions sufficient to vaporize the solid carbon dioxide, and hence expand the cut filler. High temperature gas 130 (e.g., a steam laden gas) is recirculated and reheated using heat from an incinerator or other suitable heating device. Suitable incinerators, sources of moisture, fans and related devices, which are provided to supply the desired stream of high temperature gas, will be apparent to the skilled artisan. The high temperature gas normally includes air, and can include steam. Preferably, the high temperature gas includes steam, and can consist primarily of steam. An exemplary high temperature gas 130 comprises about 73 weight percent water, about 17 weight percent carbon dioxide and about 10 weight percent air; and exhibits a temperature of about 700° F. to about 950° F. Another exemplary high temperature gas 130 comprises about 85 weight percent water, about 10 weight percent carbon dioxide and about 5 weight percent air; and exhibits a temperature of about 700° F. to about 950° F. For a high temperature gas of relatively low temperature (i.e., about 700° F. or less), adequate expansion of the cut filler can be provided by employing cut filler having a relatively low moisture, employing ducts of relatively long length to provide longer residence times for the cut filler in the sublimator region, and increasing the volume of high temperature gas which contacts the cut filler. The high temperature gas normally travels at a rate of about 6,000 to about 9,000, preferably about 7,000 to about 8,000 ft./min. in the venturi area where the tabacco material and gas meet. The tobacco cut filler is entrained 138 in a stream of the high temperature gas 130, and travel through duct 120 in an overall horizontal direction. A vertical duct 140 is provided, and the cut filler and travels upward 142 through duct 140. The tobacco cut filler experiences rapid heating 145 (e.g., an increase in temperature of about −109° F. to about 300° F., usually from about −109° F. to a temperature in the range of about 180° F. to about 280° F.) so as to yield volume expanded cut filler 150. On average, the tobacco cut filler remains in contact with the high temperature gas for about 1 to about 6, preferably about 3 to about 5 seconds. The inner diameter of the tubular duct 140 is significantly greater in the vertically extending direction than in the horizontally extending direction adjacent rotary valve. The vertically extending duct 140 is described in greater detail with reference to FIG. 3.

The volume expanded cut filler 150 and high temperature gas pass through tangential separator 158, or other suitable separation means. An exemplary separator and the operation thereof will be apparent to the skilled artisan. The tangential separator allows high temperature gas to be circulated back to the incinerator heat exchanger, and reheated for recirculation through duct 120. Optionally, the high temperature gas exiting the tangential separator can be passed through at least one cyclone separator to remove suspended matter (e.g., tobacco dust) from the high temperature gas. Volume expanded cut filler exits the separator 158 and normally exhibits a temperature of about 150° F. to about 320° F., often about 170° F. to about 300° F., and frequently about 200° F. to about 360° F.; and generally exhibits a moisture content of less than about 2 weight percent, frequently less than about 1 weight percent. The cut filler 150 falls downward 160 through a container housing 165 which connects the tangential separator to airlock 167, and provides a contained channel for the cut filler 150 to pass. Airlock 167 provides for the continuous or continual removal of tobacco material from the sublimator (i.e., expansion) region while allowing for the continuous stream of gas to be maintained.

During the time that the volume expanded cut filler 150 falls downward through the housing 165, the cut filler is contacted with a liquid 168. Preferably, the liquid is one having an aqueous character, and usually is tap water. Normally, the liquid is supplied at a temperature of about 40° F. to about 100° F., and frequently about 50° F. to about 80° F. The liquid is supplied into the housing in order to cool, and preferably moisten, the tobacco material which passes through that housing. Cooling of the tobacco material in the housing 165 is desirable in order to reduce the propensity of that tobacco material to undergo (i) undesirable charring or browning, and (ii) a significant but undesirable change in chemical composition. Tobacco material present in the housing experiences a tendency to be subjected to an undesirably high degree of heating due to the residence time of that material in the housing, and the propensity of the housing to be heated convectively or conductively (e.g., due to the high temperatures experienced in the tangential separator region of the apparatus). The liquid 168 is supplied in a manner which can vary, but typically is in the form of a spray or mist. A spray tends to contact the tobacco material passing through the housing, and hence moisten and cool that material to a significant degree; while a mist tends to evaporate and hence cool the atmosphere within the housing. For most applications, a liquid such as water is supplied as a spray into the housing at a rate of about 10 to about 180 gallons/hr., often about 20 to about 150 gallons/hr., and frequently about 50 to about 100 gallons/hr. For example, for a process whereby about 6,500 lb./hr. of expanded tobacco material at a moisture content of about 1 weight percent passes through the housing, about 70 gallon/hr. of water at about 60° F. provides a cooled, expanded tobacco material having a moisture content of about 3 weight percent. In addition, cooling of the atmosphere in the channel housing provides for cooling of the airlock (e.g., a rotary valve) so as to (i) minimize valve failure resulting from excessive exposure to excessive heat, and (ii) minimize the tendency of expanded tobacco material to be charred or scorched upon contact with a very hot airlock.

The tangential separator 158, housing 165 and source of liquid are described in greater detail with reference to FIG. 4.

The volume expanded cut filler 150, which has a temperature of about 180° F. to about 260° F., and a moisture content of about 1 to about 10 weight percent, usually about 2 to about 5 weight percent, exits 175 the housing channel 165 through airlock 167. An exemplary airlock and the operation thereof will be apparent to the skilled artisan. For example, the airlock can be a water cooled rotary valve, such as a commercially available rotary valve having a water cooled rotor and/or housing. As such, volume expanded cut filler 150 exits 178 the airlock 167, and is deposited onto a vibrating belt conveyor 180. Optionally, the volume expanded cut filler 150 on the belt conveyor is sprayed 185 with liquid (e.g., water at 60° F.) using atomized spray techniques, so as to moisten the tobacco material prior to reordering. As such, a tobacco cut filler having a slightly increased moisture content is provided. The volume expanded cut filler then is passed to a reordering drum 190. For example, the tobacco cut filler is treated in a 3-zone reordering drum (e.g., 50 lb./hr. spray of water at 60° F. in zone 1; 250 lb./hr. spray of water at about 60° F. in zone 2; and 300 lb./hr. spray of water at about 60° F. in zone 3; for each 5,000 pounds dry weight of tobacco cut filler) so as to provide an expanded cut filler having a moisture content of about 12 weight percent. If desired, the expanded tobacco cut filler can be treated as described in U.S. Pat. No. 4,202,357 to de la Burde et al. The reordered volume expanded tobacco cut filler 200 is subjected to air separation conditions 205 (e.g., using a Swan separator from Griffin) so as to provide removal of undesirable tobacco stems, unexpanded tobacco material, "iceballs" and foreign materials from the desirable expanded cut filler. The collected volume expanded cut filler then is conveyed 208 to bulkers 210 for blending 215 with other tobacco cut filler material for use in smoking article manufacture 217.

The process can be controlled using a programmable control unit, or a programmable logic controller (i.e., PLC). An exemplary PLC is available as PLC 525 from Allen Bradley. Another method for process control is the Distributed Process Control System (i.e., DPCS). An exemplary DPCS is available from CRISP Automation. As such, there can be provided automatic control of operations such as the feed of tobacco cut filler into the pressure vessel, the discharge of tobacco cut filler from the pressure vessel, the opening and closing of the pressure vessel, the checking for fluid leaks in the apparatus, the feeding and discharge of process fluid, the operation of fans, valves and airlocks, the recovery of process fluid, and process fluid flow parameters.

Figure 2:
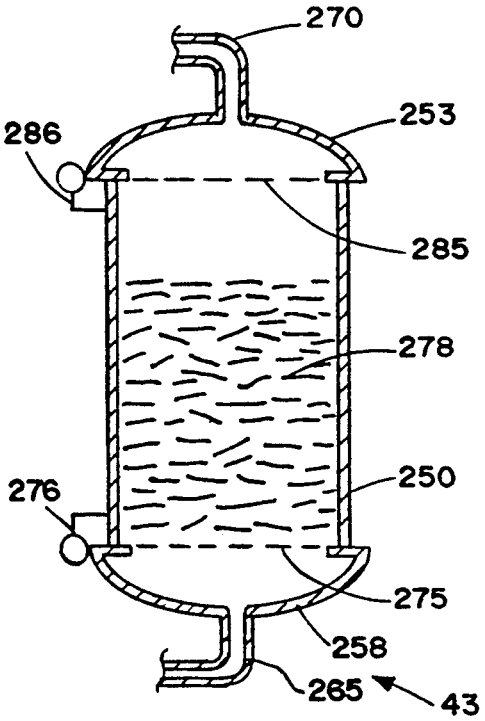
FIG. 2 is a schematic cross-sectional view of a pressure vessel useful for performing certain process steps of the present invention.

Referring to FIG. 2, pressure vessel 43 includes a body portion 250 fitted with a hinged cover or lid 253 at the top, and a hinged door or lid 258 at the bottom. The vessel is characteristic of an autoclave, and is manufactured from materials such as stainless steel materials, and is constructed so as to withstand the temperatures and pressures experienced in carrying out the process of the present invention. As such, the pressure vessel provides a means for providing a controlled pressure environment. The top lid 253 preferably includes a high pressure seal (not shown), such as a silicon/rubber seal of about 1 inch width having a seal face which is radiused outwards about 1 mm. A similar high pressure seal (not shown) is positioned at the bottom of the body portion 250. The vessel 43 includes at least one line or port 265, near the bottom of the vessel. As such, the interior of the vessel can be purged with gaseous fluid (e.g., gaseous carbon dioxide), as well as liquid fluid (e.g., liquid carbon dioxide); and such fluids (particularly the liquid fluid) also can be removed from the vessel. The vessel 43 includes at least one line or port 270, near the top of the vessel. As such, gaseous fluid (e.g., gaseous carbon dioxide) can be vented from the vessel. The vessel includes a lower wire mesh screen 275 horizontally positioned within the body portion and movable with the bottom lid about hinge 276, and configured so as to contain and support the tobacco material 278 which is to be processed. The vessel also includes an upper wire mesh screen 285 horizontally positioned within the body portion and movable with the top lid about hinge 286, and configured so as to prevent the tobacco material which is to be processed from being undesirably removed from the vessel. The ports 265, 270 are in turn connected to suitable fluid sources or recovery vessels using suitable valve arrangements. Such arrangements will be apparent to the skilled artisan. The lines or ports 265, 270 include swivel joints (not shown) in order that the respective lids 253, 258 can be repeatedly opened and closed.

Figure 3:
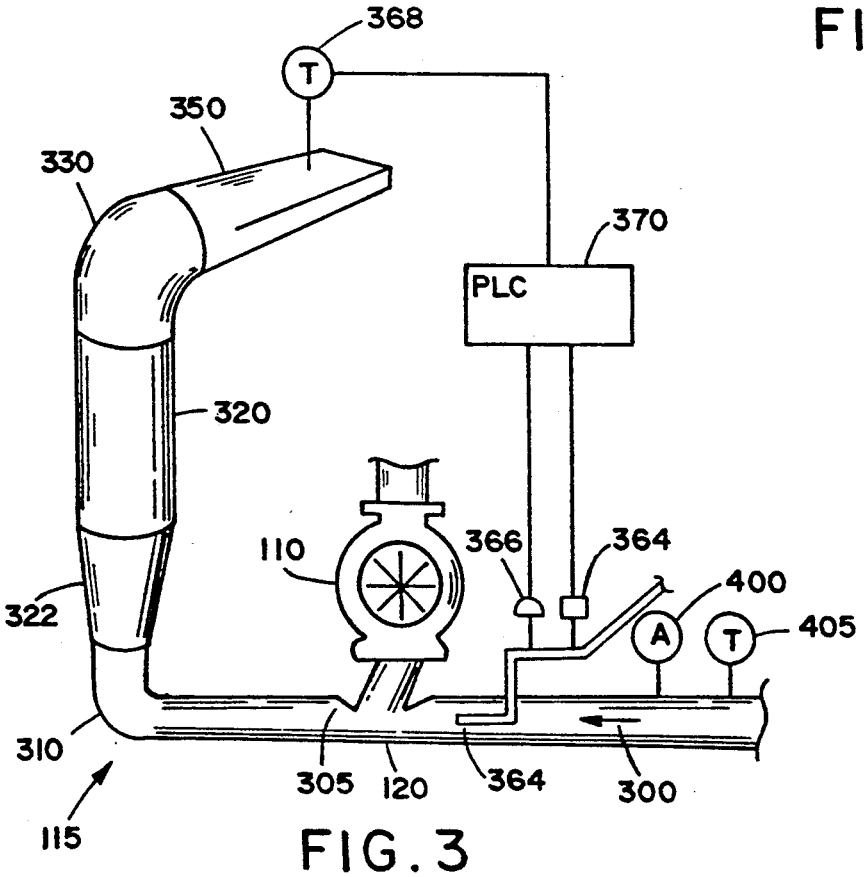
FIG. 3 is a schematic diagram of a portion of the apparatus useful for performing certain process steps of the present invention.

Referring to FIG. 3, there is shown sublimator region 115. Solid carbon dioxide-containing cut filler (not shown) exits airlock 110 into tubular duct 120. The tubular duct 120 preferably extends in a generally horizontal direction such that the cut filler falls downwardly into the duct. A stream of high temperature gas (shown to travel through the duct in the direction indicated by arrow 300) from a source (not shown) entrains the cut filler in venturi region or area 305. Preferably, the cut filler is dropped directly into the venturi area. The duct 120 has a slightly decreased cross-sectional area relative to the rest of duct 120 in the venturi area in order that the tobacco cut filler has a tendency to be more readily accelerated through the horizontally extending duct by the steam of high temperature gas. Typically, the venturi area (i) has a decreased cross-sectional area of about 30 percent relative to that of the rest of the horizontally extending duct, and (ii) extends about 1 to about 5 feet along the length of the horizontally extending duct. Preferably, the walls of the duct 120 taper inward gradually to provide the venturi area to provide for desirably fluid flow dynamics. The various ducts of the sublimator region can be equipped throughout, as desired or as necessary, with impingement plates (not shown), particularly in the regions of the turns in the ducts. The stream of gas carries the cut filler through a 90° turn 310 in the duct and into a vertically extending duct 320 of increased inner diameter relative to the horizontally extending duct 120. Preferably, the horizontally extending duct does not experience an increase in diameter in order to insure that the tobacco material is accelerated adequately into the vertically extending duct. Normally, the diameter of the duct 320 increases gradually (e.g., at an angle of about 15° relative to vertical) in region 322. See, *Industrial Ventilation*, (20th Ed., 1988). Preferably, the ducts 120 and 320 are insulated using insulation (not shown). The increased inner diameter of the duct provides for an increased residence time of the tobacco material in contact with the high temperature gas stream, desirably high turbulence of the tobacco material in the duct, and an improved uniformity of heat transfer from the gas to the tobacco material. As such, the conveyance of clumped unexpanded tobacco materials (i.e., "iceballs") is decreased, and hence the expansion of the tobacco material is improved. For example, the cut filler can undergo a decrease in velocity from 7,500 ft/min. to 2,500 ft./min. when transferred from a horizontally extending duct having an inner diameter of about 27.5 inches to a vertically extending duct having an inner diameter of about 48 inches. In most circumstances, the cut filler in the vertically extending duct exhibits an average velocity of about 1,500 to about 4,000 ft./min. For a duct having a generally circular inner cross-sectional shape, the inner diameter of the vertically extending duct normally is about 1.3 to about 2, and preferably about 1.5 to about 1.8 times that of the horizontally extending duct. A typical vertically extending duct has a maximum length of about 10 to about 20 feet and a maximum inner diameter of about 55 inches. The vertically extending duct 320 then experiences a 90° turn 330 to become an upper horizontally extending duct 350. Preferably, the duct maintains its increased inner diameter through the turn 330. The tobacco material entrained in the stream of gas passes through upper horizontally extending duct 350 into a tangential separator (not shown). The region of the duct having the increased inner diameter normally extends about 50 to about 90, preferably about 60 to about 80 percent of the length of that duct between the airlock 110 and the tangential separator. Preferably, the increase in inner diameter of the duct does not occur until beyond turn 310 when the duct extends in a vertical direction.

Upstream of airlock 110 but downstream of the source of high temperature gas is positioned water injector unit 360 Such unit 360 includes a tubular end 362 within duct 120, solenoid valve 364 and globe (i.e., control) valve 366, and provides for decreased propensity of airlock 110 to overheat and cease operation. Within the ducts, preferably within upper duct 350, is positioned a temperature sensor 368, such as a Type K Rosemount thermocouple. The sensor monitors the temperature within the duct, preferably in the region thereof near the tangential separator. The sensor 368 is connected as an input to a PLC 370. The PLC provides an output which acts to open the solenoid and control valves, which allow liquid water from a source (not shown) to be fed into the duct through tube 362 The PLC is programmed such that when the sensor detects a temperature above a predetermined temperature (e.g., about 10° F. or more above the normal steady state temperature within the duct). The PLC acts to open the solenoid and control valves thereby permitting a controlled amount of liquid water to be fed into the high temperature stream of gas. As such, the liquid evaporates and acts as a heat sink to lower the temperature within the duct. When the sensor detects a temperature below the predetermined level, the PLC acts to close the control valve, thereby reducing or ceasing the feed of liquid water into the duct so as to maintain the temperature within the duct at a desired steady state temperature. As such, there is provided a temperature control mechanism for the duct. Software for the PLC, connection mechanisms and other assembly details of the temperature control mechanism will be apparent to the skilled artisan.

Further upstream of water injector unit 360 is an annubar 400 which provides for measure of the velocity pressure in the duct in order that the flow rate of the stream of high temperature gas can be monitored. The gas flow through the ducts can be controlled by a damper (not shown) which can, in turn, be opened or closed to provide the desired gas flow as provided by the process fan (not shown). Further upstream of annubar 400 is thermocouple 405 (e.g., a type K thermocouple) in order to provide for measure of the temperature of the high temperature gas.

Figure 4:
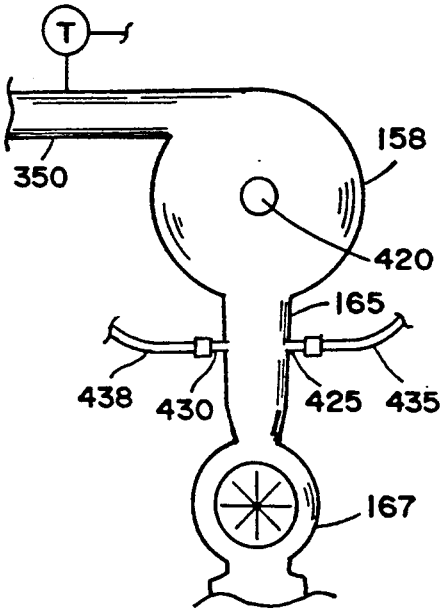
FIG. 4 is a schematic diagram of a portion of the apparatus useful for performing certain process steps of the present invention.

Referring to FIG. 4, there is shown a tangential separator 158 and channel housing 165 for expanded cut filler (not shown) to pass. Expanded cut filler within duct 350 passes through the separator and falls in vertically extending channel 165. Hot gas passes through at least one air return duct 420, and is recycled. A typical channel 165 has a rectangular, cross-sectional shape; a height of about 2 to about 4 feet, preferably about 3 feet; and cross-sectional area of about 4 to about 10 $ft.^2$, preferably about 6 $ft.^2$. The cross-sectional shape and dimensions of the housing can change from top to bottom (e.g., a channel having a large, rectangular cross-sectional shape can gradually undergo a decrease in cross-sectional shape from the tangential separator to the airlock, where the housing channel may have a generally circular cross-sectional shape). A typical channel includes a plurality of ports 425, 430 positioned in the walls thereof. The ports can be positioned on all of the walls, on one of the walls, or on some of the walls. The spacing of the ports can vary. For example, three ports each can be positioned on opposite walls of the channel. Thus, a typical channel includes 3 horizontally aligned ports about 8 to about 20 inches from top thereof, and spaced apart about 8 inches on each opposite wall. For a representative channel housing having a height of about 30 inches and having a rectangular cross section, ports can be positioned on opposite sides; and on one side 3 ports can be spaced horizontally 9 inches apart about 22 inches from the top of the channel housing, and on the opposite side 3 ports can be spaced horizontally 8 inches apart about 10 inches from the top of the channel housing. The ports can be aligned horizontally, diagonally, vertically, or in a pattern on one or more of the walls. The ports on opposite or adjacent walls can be off-set relative to one another in order to provide a controlled application of liquid into the channel housing.

The type of port can vary. The port can have the shape of a circular orifice (e.g., by drilling a 1/32 to 3/32, preferably a 1/16 inch diameter hole through a coupling nozzle extending into the wall). The port can have the form of a slotted nozzle (e.g., by flattening a metal pipe to form a rectangular slot of about 0.01 inch by about 0.5 inch). The port can have the form of a hollow cone, fine mist nozzle (e.g., such as is available as ¼ LND-SS26 from Spraying Systems Co.). Other port shapes and other nozzles can be employed, and more than one type of port can be employed. Liquid can pass through one port, through more than one port, or through all of the ports. The type of port can determine the manner in which the liquid, such as tap water from a source (not shown) through liquid transfer lines 435, 438 is transferred into the channel. Suitable valves and plumbing arrangements for providing transfer of liquid into the housing channel will be apparent to the skilled artisan. For example, the circular orifice tends to provide a stream of liquid; the slotted nozzle tends to provide a horizontal or vertical spray pattern; and the hollow cone nozzle tends to provide a cone-shaped fine mist. The nozzle or orifice can be positioned so as to direct a flow of liquid into the channel housing in a desired direction. The amount of liquid which is applied to the tobacco cut filler falling through the channel can vary. Typically, about 10 gal./hr. to about 120 gal./hr., preferably 20 to 80 gal./hr. of liquid are applied to 4,500 pounds of expanded cut filler. The cut filler passes through the channel and exits the airlock 167 to a collection means such as a conveyor (not shown).

For purposes of the present invention, the filling capacity of a particular volume expanded tobacco material is determined by charging the material of a known weight into a tube having a height of about 200 mm and an inner diameter of about 96 mm. Typically, enough expanded tobacco material is employed to fill the tube about ¾ full. A piston having a height of about 170 mm and an outer diameter of about 93.5 mm includes a support housing such that the piston and housing weighs about 26 pounds. The piston is lowered onto the tobacco material and is allowed to rest thereon. After the piston and housing rests on the tobacco material for 5 seconds, the volume occupied by that material within the cylinder is recorded. Typical high filling capacity values for tobacco materials which are expanded according to the process of the present are greater than about 750, often are greater than about 900, and even can be greater than about 1,000. Such filling capacity values are reported in units of milliliters per 2.3 psi per 100 g of tobacco material at 12 weight percent moisture at 76° F. (24.4° C.) as determined using the previously described procedure. Although the degree to which the tobacco material is volume expanded can vary, typical tobacco materials experience an increase in volume and filling capacity of about 80 to about 120 percent when processed according to the present invention.

The present invention provides several improvements to the DIET process and equipment. The present invention allows the DIET process and equipment to be employed in an efficient and effective manner, particularly due to (i) a control of the conditions under which the tobacco material is treated or handled, and (ii) control of the heat experienced by the tobacco material and expansion equipment during expansion and collection stages of the expansion process. In one aspect, the tobacco material is subjected to conditions so as to limit its degradation and improve the conditions under which it is expanded (e.g., by improving the manner in which the liquid fluid is solidified and by increasing the residence time of the tobacco material in the sublimation duct). In another aspect, the tobacco material does not experience overly long periods of contact with high temperature atmosphere at overly high temperatures, thus resulting in expanded tobacco materials which (i) are of desirably light color (e.g., is not discolored, toasted, charred or burned), and (ii) have not undergone chemical modification to an undesirable degree. In yet another aspect, the tobacco material which experiences a decreased velocity in the vertically extending duct exhibits a tendency to be spread out in the tangential separator region, and hence exhibits less of a tendency to be removed along with the high temperature gas which is recovered and recycled using the separator (i.e., as such the yield of the expanded tobacco material which is collected for use is improved).

What is claimed is:

1. A process for expanding tobacco material, the process comprising the steps of:
   (a) contacting tobacco material with a liquid fluid and a first gaseous fluid in a pressure vessel under controlled pressure conditions to provide a pressurized mixture;
   (b) decreasing pressure of the pressurized mixture so as to convert the liquid fluid to a solid state thereby providing a frozen mass of tobacco material and solidified fluid;
   (c) contacting the mixture with a second gaseous fluid at least during the period that the liquid fluid is converted to a solid state by introducing the second fluid into the pressure vessel during that period;
   (d) subdividing the frozen mass to pieces; and
   (e) contacting the pieces of frozen mass with a gas at a temperature sufficiently high to cause sublimation of the solidified fluid and volume expansion of the tobacco material.

2. The process of claim 1 whereby the liquid fluid and the first gaseous fluid each are carbon dioxide.

3. The process of claim 2 whereby the second gaseous fluid is carbon dioxide.

4. The process of claim 1 or 2 whereby the tobacco material is in cut filler form.

5. The process of claim 1 or 3 whereby the second gaseous fluid is bubbled upwards through the mixture.

6. The process of claim 3 whereby the second gaseous fluid is contacted with the mixture when the mixture experiences a pressure below about 80 psig, and the second gaseous fluid is contacted with the mixture until the mixture experiences a pressure of below about 55 psig.

7. The process of claim 5 whereby the second gaseous fluid is contacted with the mixture when the mixture experiences a pressure below about 80 psig, and the second gaseous fluid is contacted with the mixture until the mixture experiences a pressure of below about 55 psig.

8. A process for expanding tobacco material, the process comprising the steps of:
   (a) providing pieces of tobacco material impregnated with a solidified fluid; and
   (b) contacting the pieces of tobacco material of step (a) with a stream of gas at a temperature sufficiently high to cause sublimation of the solidified fluid and volume expansion of the tobacco material; (i) the tobacco material being introduced into a tubular duct extending in a generally horizontally extending direction and including a venturi region, and the tobacco material is contacted with the stream of gas in the venturi region, in order that the tobacco material is entrained in the stream of gas and travels through the duct in an overall horizontal direction, and (ii) such that the steam of gas and entrained tobacco material then travel through a tubular duct extending in a generally vertical direction, the vertically extending tubular duct having an inner cross-sectional area greater than that of the horizontally extending duct.

9. The process of claim 8 whereby the duct in each of the horizontally extending and vertically extending directions has a generally circular cross-sectional shape, and the inner diameter of the duct extending in the vertical direction is about 1.3 to about 2 times that of the inner diameter of the duct extending in the horizontal direction.

10. The process of claim 8 or 9 whereby the material is in cut filler form.

11. A process for expanding tobacco material, the process comprising the steps of:
   (a) providing pieces of tobacco material impregnated with a solidified fluid;
   (b) introducing the pieces of tobacco material of step (a) into a duct so as to contact a stream of gas at a temperature sufficiently high to cause sublimation of the solidified fluid and volume expansion of the tobacco material;
   (c) monitoring the temperature of the gas in the duct; and
   (d) introducing a heat-sinking liquid into the duct so as to reduce the temperature within the duct to below a predetermined temperature.

12. The process of claim 11 whereby the heat-sinking liquid is water.

13. The process of claim 11 or 12 whereby the fluid is carbon dioxide.

14. The process of claim 11 or 12 whereby the tobacco material is in cut filler form.

15. A process for expanding tobacco material, the process comprising the steps of:
   (a) providing pieces of tobacco material impregnated with a solidified fluid;
   (b) contacting the pieces of tobacco material step (a) with a gas at a temperature sufficiently high to cause sublimation of the solidified fluid and volume expansion of the tobacco material;
   (c) providing for the tobacco material to fall through a vertically extending channel housing;
   (d) contacting volume expanded tobacco material with a liquid while that tobacco material is in the channel housing; and
   (d) collecting the volume expanded tobacco material.

16. The process of claim 15 further comprising reordering the volume expanded tobacco material.

17. The process of claim 15 whereby the liquid is water.

18. The process of claim 15 whereby the fluid is carbon dioxide.

19. The process of claim 15, 16 or 17 whereby the tobacco material is in cut filler form.

20. The process of claim 15 whereby the liquid has the form of a mist.

21. The process of claim 15 whereby the liquid has the form of a spray.

* * * * *